US006415252B1

(12) United States Patent
Peng et al.

(10) Patent No.: US 6,415,252 B1
(45) **Date of Patent: *Jul. 2, 2002**

(54) METHOD AND APPARATUS FOR CODING AND DECODING SPEECH

(75) Inventors: Weimin Peng, Mundelein; James Patrick Ashley, Naperville, both of IL (US)

(73) Assignee: Motorola, Inc., Schaumburg, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/086,396

(22) Filed: May 28, 1998

(51) Int. Cl.[7] ..... G10L 11/06; G10L 19/04
(52) U.S. Cl. ..... 704/208; 704/217; 704/223
(58) Field of Search ..... 704/223, 220, 704/221, 207, 208, 217, 214, 226, 227, 229, 216, 219

(56) References Cited

U.S. PATENT DOCUMENTS 5,138,661 A * 8/1992 Zinser et al. ..... 704/219
5,548,680 A * 8/1996 Cellario ..... 704/219
5,596,676 A * 1/1997 Swaminathan et al. ..... 704/208
5,930,747 A * 7/1999 Iijima et al. ..... 704/207
6,199,035 B1 * 3/2001 Lakaniemi et al. ..... 704/207

OTHER PUBLICATIONS

Serizawa et al., "4 kbps improved pitch prediction CELP speech coding with 20 ms frame," 1995 International Conference on Acoustics, Speech, and Signal Processing, vol. 1, May 1995, pp. 1 to 4.*
Unno et al., "The multimode multipulse excitation vocoder," 1997 IEEE International Conference on Acoustics, Speech, and Signal Processing, vol. 3, Apr. 1997, pp. 1683 to 1686.*
Gerson et al "Techniques for Improving the Performance of CELP–Type Speech Coders" Apr. 1997, IEEE, 858–865.*
Deller et al "Discrete–time processing of speech signals" 1993, Prentice–Hall, 159.*
Kondoz "Digital Speech" John Wiley, 1994, 53–54.*

* cited by examiner

*Primary Examiner*—William Korzuch
*Assistant Examiner*—Martin Lerner
(74) *Attorney, Agent, or Firm*—Richard A. Sonnentag; Charles W. Bethards; Lalita P. Williams

(57) ABSTRACT

Bits are allocated to short-term repetition information for unvoiced input signals. Stated differently, more bits are allocated for pitch information during unvoiced input speech than in the prior art. The improved method and apparatus in an encoder (300) and decoder (700) result in improved consistency of amplitude pulses compared to prior art methods which indicates improved stability due to increased search resolution. Also, the improved method and apparatus result in higher energy compared to prior art methods which indicates that the synthesized waveform matches the target waveform more closely, resulting in a higher fixed codebook (FCB) gain.

3 Claims, 3 Drawing Sheets

-PRIOR ART-

700

METHOD AND APPARATUS FOR CODING AND DECODING SPEECH

RELATED APPLICATION

The present application is related to Ser. No. 09/086,149 now U.S. Pat. No. 6,141,638 issued Oct. 31, 2000 titled "METHOD AND APPARATUS FOR CODING AN INFORMATION SIGNAL" filed on the same date herewith, assigned to the assignee of the present invention and incorporated herein by reference.

FIELD OF THE INVENTION

The present invention relates, in general, to communication systems and, more particularly, to coding information signals in such communication systems.

BACKGROUND OF THE INVENTION

Code-division multiple access (CDMA) communication systems are well known. One exemplary CDMA communication system is the so-called IS-95 which is defined for use in North America by the Telecommunications Industry Association (TIA). For more information on IS-95, see TIA/EIA/IS-95, Mobile Station-Base-station Compatibility Standard for Dual Mode Wideband Spread Spectrum Cellular System, March 1995, published by the Electronic Industries Association (EIA), 2001 Eye Street, N.W., Washington, D.C. 20006. A variable rate speech codec, and specifically Code Excited Linear Prediction (CELP) codec, for use in communication systems compatible with IS-95 is defined in the document known as IS-127 and titled Enhanced Variable Rate Codec, Speech Service Option 3 for Wideband Spread Spectrum Digital Systems, January 1997. IS-127 is also published by the Electronic Industries Association (EIA), 2001 Eye Street, N.W., Washington, D.C. 20006.

In modern CELP coders, there is a problem with maintaining high quality speech reproduction at low bit rates. The problem originates since there are too few bits available to appropriately model the "excitation" sequence or "codevector" which is used as the stimulus to the CELP synthesizer. One common method which has been implemented to overcome this problem is to differentiate between voiced and unvoiced speech synthesis models. However, this prior art suffers from problems as well. Thus, a need exists for an improved method and apparatus which overcomes the deficiencies of the prior art.

DETAILED DESCRIPTION OF THE PREFERRED EMBODIMENT

Stated generally, bits are allocated to short-term repetition information for unvoiced input signals. Stated differently, more bits are allocated for repetition information during unvoiced input speech than are allocated for pitch information during voiced speech in the prior art. The improved method and apparatus result in improved consistency of amplitude pulses compared to prior art methods which indicates improved stability due to increased search resolution. Also, the improved method and apparatus result in higher energy compared to prior art methods which indicates that the synthesized waveform matches the target waveform more closely, resulting in a higher fixed codebook (FCB) gain.

Stated more specifically, a method for coding a signal having random properties comprises the steps of partitioning the signal into finite length blocks and analyzing the finite length blocks for short term periodic properties to produce a repetition factor. Each finite length block is coded to produce a codebook index representing a sequence, where the sequence is substantially less than a finite length block and the codebook index and the repetition factor are transmitted to a destination. The finite length blocks further comprise a subframe. The step of analyzing the finite length blocks for short term periodic properties to produce a repetition factor for each frame further comprises the step of analyzing the finite length blocks for short term periodic properties to produce an independent repetition factor for each frame. The codebook index and the repetition factor represent an excitation sequence in a CELP speech coder. A corresponding apparatus performs the inventive method.

Stated differently, a method of coding speech comprises the steps of determining a voicing mode of the an input signal based on at least one characteristic of the input signal and allocating bits to short-term repetition parameters when the voicing mode is unvoiced. In one embodiment, 12 bits are allocated for a repetition factor $\tau_s$ and 36 bits are allocated for a codebook index k in a 4 kbps speech coder when the voicing mode is unvoiced while in an alternate embodiment, 12 bits are allocated for a repetition factor rs and $\tau_s$ and 60 bits are allocated for a codebook index k in a 5.5 kbps speech coder when the voicing mode is unvoiced.

Figure 1:
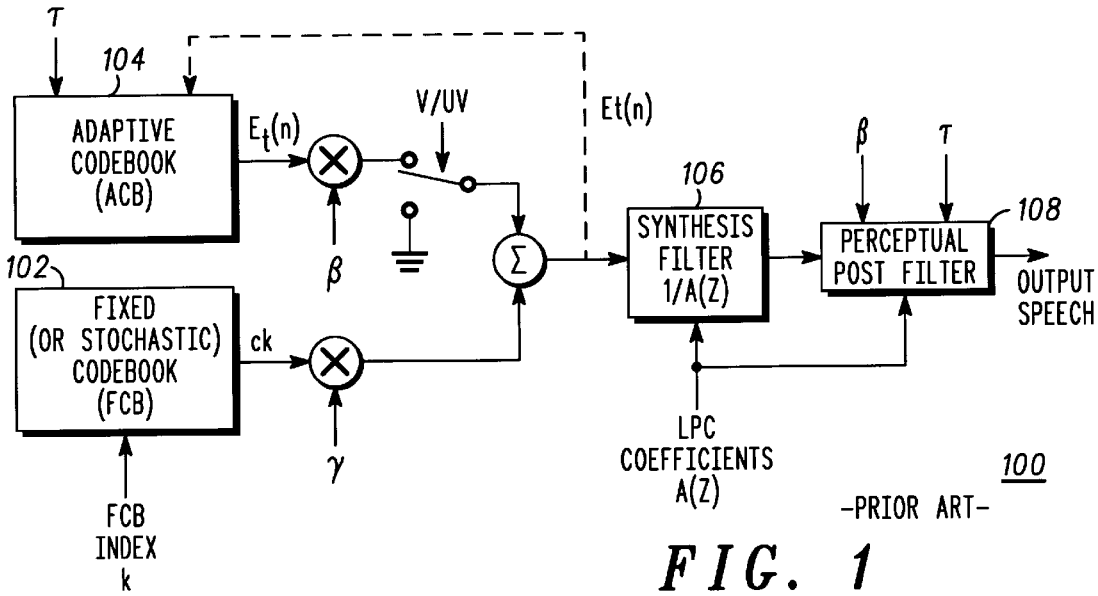
FIG. 1 generally depicts a prior art CELP decoder implementing a voiced/unvoiced classification.

To better understand the inventive concept of a fixed codebook (FCB) CELF encoder implementing closed loop analysis of unvoiced speech in accordance with the invention, it is necessary to describe the prior art. FIG. 1 generally depicts a prior art CELP decoder 100 implementing a voiced/unvoiced classification. As shown in FIG. 1, the excitation sequence or "codevector" $c_k$ is generated from a fixed codebook (FCB) 102 using the appropriate codebook index k. This signal is scaled using an FCB gain factor $\gamma$ and, depending on the voicing mode, combined with a signal $E_t(n)$ output from an adaptive codebook (ACB) 104 and scaled by a factor of $\beta$. The signal $E_t(n)$, which represents the total excitation, is used as the input to a LPC synthesis filter 106, which models the coarse short term spectral shape, commonly referred to as "formants". The output of filter 106 is then perceptually post-filtered in perceptual post filter 108 where the coding distortions are effectively "masked" by amplifying the signal spectra at frequencies which contain high speech energy, and attenuating those frequencies which contain less speech energy. Additionally, the total excitation signal $E_t(n)$ is used as the adaptive codebook for the next block of synthesized speech.

Since ACB 104 is used primarily to model the long term (or periodic) component of a speech signal (with period $\tau$), an unvoiced classification may essentially disable ACB 104, and allow reallocation of the respective bits to refine the accuracy of FCB 102 excitation. This can be rationalized by the fact that unvoiced speech generally contains only noise-like components, and is void of any long-term periodic characteristics.

Figure 2:
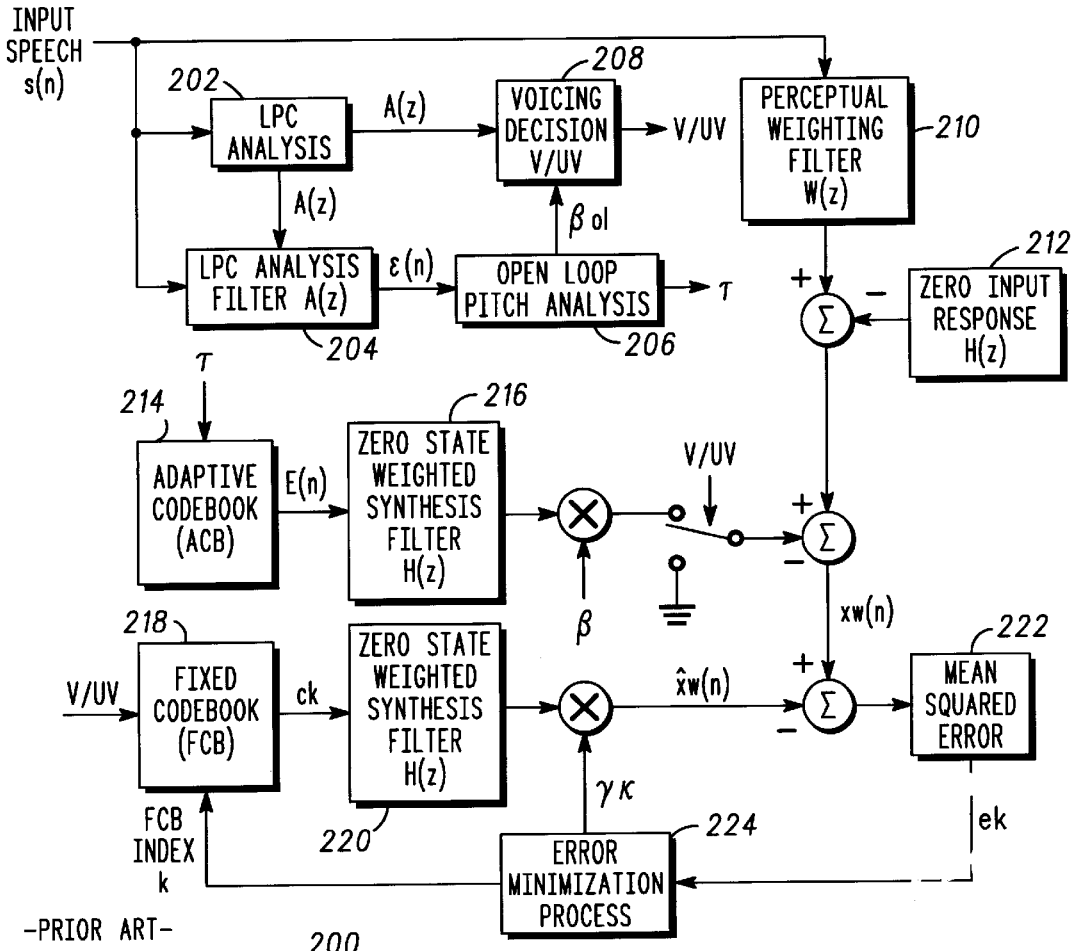
FIG. 2 generally depicts a prior art CELP encoder implementing a voiced/unvoiced classification.

FIG. 2 generally depicts a prior art CELP encoder 200 implementing a voiced/unvoiced classification. Referring to FIG. 2, the frames of input speech s(n) are subjected to linear predictive coding (LPC) techniques in blocks 202 and 204 in which the coarse spectral information is estimated. This analysis produces a set of direct form filter coefficients A(z) that can be used to "whiten" (i.e., flatten the spectrum of) the input speech sequence by filtering s(n) through A(z) to produce the LPC residual $\epsilon(n)$. An estimate of the pitch period $\tau$ and the open-loop pitch prediction gain $\beta_{ol}$ generated by block 206 are then made from the LPC residual $\epsilon(n)$. Examples of LPC analysis and open-loop pitch prediction can be found in section 4.2 of IS-127.

Using the LPC coefficients A(z) and $\epsilon(n)$ and the open-loop pitch prediction gain $\beta_{ol}$, it is possible to make a reasonable decision regarding the voicing mode of the current speech frame using voicing decision block 208. A simple, but reliable example of a voicing decision is as follows:

$$\begin{aligned} &\text{if } \beta_{ol} > 0.3 \text{ or } r_c(1) < -0.4 \text{ then} && V/UV = \text{voiced} \\ &\text{else} && V/UV = \text{unvoiced} \end{aligned}$$

where $r_c(1)$ is the first reflection coefficient of A(z). Methods for deriving $r_c(1)$ from A(z) are well known to those skilled in the art. The test of the first reflection coefficient measures the amount of spectral tilt. Unvoiced signals are characterized by high frequency spectral tilt coupled with low pitch prediction gain. Referring again to FIG. 2, the perceptually weighted target signal $x_w(n)$, which can be represented in terms of the z-transform, can be expressed as:

$$X_w(z) = \begin{cases} S(z)W(z) - \beta E(z)H_{ZS}(z) - H_{ZIR}(z), & V/UV = \text{voiced} \\ S(z)W(z) - H_{ZIR}(z), & V/UV = \text{unvoiced} \end{cases} \tag{1}$$

where W(z) is output from perceptual weighting filter 210 and is in the form:

$$W(z) = \frac{A(z/\lambda_1)}{A(z/\lambda_2)}, \tag{2}$$

and H(z) is output from perceptually weighted synthesis filter 212 and is in the form:

$$H(z) = \frac{1}{A_q(z)} W(z), \tag{3}$$

and where A(z) are the unquantized direct form LPC coefficients, $A_q(z)$ are quantized direct form LPC coefficients, and $\lambda_1$ and $\lambda_2$ are perceptual weighting coefficients. Additionally, $H_{ZS}(z)$ is the "zero state" response of H(z), in which the initial state of H(z) is all zeroes, and $H_{ZIR}(z)$ is the "zero input response" of H(z), in which the previous state of H(z) is allowed to evolve with no input excitation. The initial state used for generation of $H_{ZIR}(z)$ is derived from the total excitation $E_t(n)$ from the previous subframe. Also, E(z) is the contribution from ACB 214 and $\beta$ is the closed-loop ACB gain.

The present invention deals with the FCB closed loop analysis during unvoiced speech mode to generate the parameters necessary to model $x_w(n)$. Here, the codebook index k is chosen to minimize the mean squared error between the perceptually weighted target signal $x_w(n)$ and the perceptually weighted excitation signal $\hat{x}_w(n)$. This can be expressed in time domain form as:

$$\min_k \left\{ \sum_{n=0}^{L-1} (x_w(n) - \gamma_k c_k(n) * h(n))^2 \right\}, \; 0 \le k < M, \tag{4}$$

where $C_k(n)$ is the codevector corresponding to FCB codebook index k, $\gamma_k$ is the optimal FCB gain associated with codevector $C_k(n)$, h(n) is the impulse response of the perceptually weighted synthesis filter 220, M is the codebook size, L is the subframe length, * denotes the convolution process and $\hat{x}_w(n)=\gamma_k c_k(n)*h(n)$. In the preferred embodiment, speech is coded every 20 milliseconds (ms) and each frame includes three subframes of length L.

Eq. 4 can also be expressed in vector-matrix form as:

$$\min_k \{(x_w-\gamma_k Hc_k)^T(x_w-\gamma_k Hc_k)\}, \; 0 \le k < M, \tag{5}$$

where $c_k$ and $x_w$ are length L column vectors, H is the L×L zero-state convolution matrix:

$$H = \begin{bmatrix} h(0) & 0 & 0 & \cdots & 0 \\ h(1) & h(0) & 0 & \cdots & 0 \\ h(2) & h(1) & h(0) & \cdots & 0 \\ \vdots & \vdots & \vdots & \ddots & \vdots \\ h(L-1) & h(L-2) & h(L-3) & \cdots & h(0) \end{bmatrix}, \tag{6}$$

and $^T$ denotes the appropriate vector or matrix transpose. Eq. 5 can then be expanded to:

$$\min_k \{x_w^T x_w - 2\gamma_k x_w^T Hc_k + \gamma_k^2 c_k^T H^T Hc_k\}, \; 0 \le k < M, \tag{7}$$

and the optimal codebook gain $\gamma_k$ for codevector $c_k$ can be derived by setting the derivative (w.r.t. $\gamma_k$) of the above expression to zero:

$$\frac{\partial}{\partial \gamma_k}(x_w^T x_w - 2\gamma_k x_w^T Hc_k + \gamma_k^2 c_k^T H^T Hc_k) = 0, \tag{8}$$

and then solving for $\gamma_k$ to yield:

$$\gamma_k = \frac{x_w^T Hc_k}{c_k^T H^T Hc_k}. \tag{9}$$

Substituting this quantity into Eq. 7 produces:

$$\min_k \left\{ x_w^T x_w - \frac{(x_w^T Hc_k)^2}{c_k^T H^T Hc_k} \right\}, \; 0 \le k < M. \tag{10}$$

Since the first term in Eq. 10 is constant with respect to k, we can rewrite it as:

$$\max_k \left\{ \frac{(x_w^T Hc_k)^2}{c_k^T H^T Hc_k} \right\}, \; 0 \le k < M. \tag{11}$$

From this equation, it is important to note that much of the computational burden associated with the search can be avoided by precomputing the terms in Eq. 11 which do not depend on k, i.e., $d^T = x_w^T H$ and $\Phi = H^T H$. With this in mind, Eq. 11 reduces to:

$$\max_k \left\{ \frac{(d^T c_k)^2}{c_k^T \Phi c_k} \right\}, 0 \le k < M, \tag{12}$$

which is equivalent to Eq. 4.5.7.2-1 in IS-127. The process of precomputing these terms is known as "backward filtering".

In the IS-127 half rate case (4.0 kbps), the FCB uses a multipulse configuration in which the excitation vector $c_k$ contains only three non-zero values. Since there are very few non-zero elements within $c_k$, the computational complexity involved with Eq. 12 is held relatively low. For the three "pulses", there are only 10 bits allocated for the pulse positions and associated signs for each of the three subframes (of length of L=53, 53, 54). In this configuration, an associated "track" defines the allowable positions for each of the three pulses within $c_k$ (3 bits per pulse plus 1 bit for composite sign of +, −, + or −, +, −). As shown in Table 4.5.7.4-1 of IS-127, pulse 1 can occupy positions 0, 7, 14, . . . , 49, pulse 2 can occupy positions 2, 9, 16, . . . , 51, and pulse 3 can occupy positions 4, 11, 18, . . . , 53. This is known as "interleaved pulse permutation." The positions of the three pulses are optimized jointly so equation (12) is executed $8^3$=512 times per subframe. The sign bit is then set according to the sign of the gain term $\gamma_k$.

One problem with the IS-127 half rate implementation is that the excitation codevector $c_k$ is not robust enough to model unvoiced speech since there are too few pulses that are constrained to too small a vector space. This results in noisy sounds being "gritty" due to the undermodeled excitation. Additionally, the synthesized signal has comparatively low energy due to poor correlation with the target signal, and hence, a low FCB gain term.

By allowing the voiced/unvoiced decision to disable ACB 214, and modifying the bit allocation, the number of bits per subframe for the FCB index can be increased from 10 bits to 16 bits. This would allow, for example, 4 pulses at 8 positions, each with an independent sign (4×3+4=16), as opposed to 3 pulses at 8 positions with 1 global sign (3×3+1=10). This configuration, however, has only a minor impact on the quality of unvoiced speech.

Other methods may include simply matching the power spectral density of an unvoiced target signal with an independent random sequence. The rationale here is that human auditory system is fundamentally "phase deaf", and that different noise signals with similar power spectra sound proportionally similar, even though the signals may be completely uncorrelated. There are two inherent problems with this method. First, since this is an "open-loop" method (i.e., there is no attempt to match the target waveform), transitions between voiced (which is "closed-loop") and unvoiced frames can produce dynamics in the synthesized speech that may be perceived as unnatural. Second, in the event that a misclassification of voicing mode occurs (e.g., a voiced frame is misclassified as unvoiced), the resulting synthetic speech suffers severe quality degradation. This is especially a problem in "mixed-mode" situations in which the speech is comprised of both voiced and unvoiced components.

While it may be intuitive to model and code noise-like speech sounds using noisy synthesizer stimuli, it is however, problematic to design a low bit-rate coding method that is random in nature and also correlates well with the target waveform. In accordance with the invention, a counter-intuitive approach is implemented. Rather than dedicating fewer bits to the periodic component as in the prior art, the present invention allocates more bits for pitch information during unvoiced mode than for voiced mode.

Figure 3:
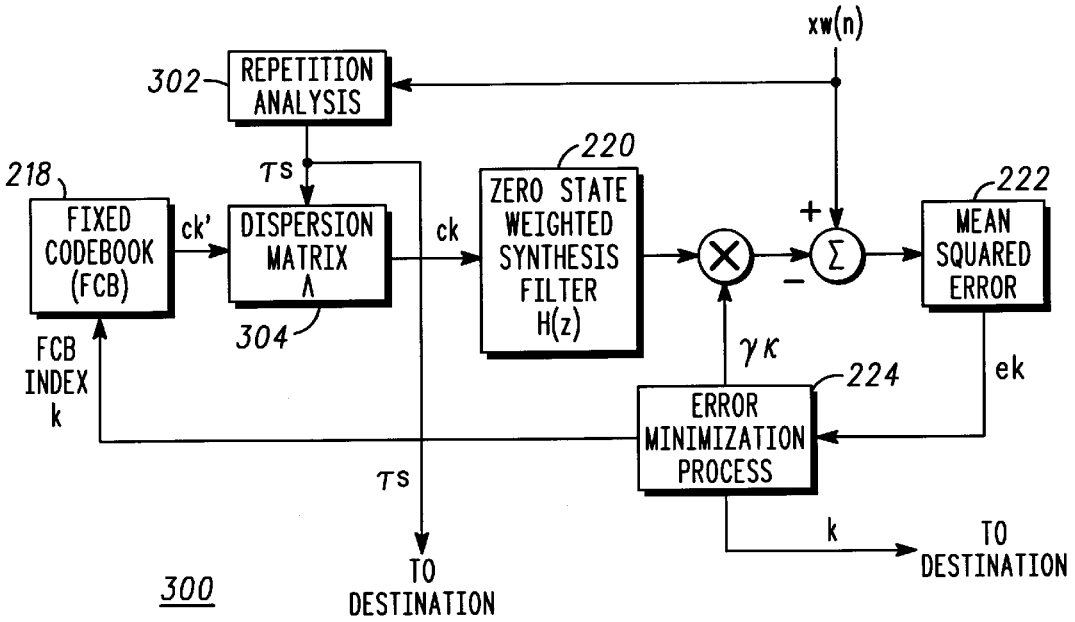
FIG. 3 generally depicts a fixed codebook (FCB) CELP encoder implementing closed loop analysis of unvoiced speech in accordance with the invention.

FIG. 3 generally depicts a fixed codebook (FCB) CELP encoder 300 implementing closed loop analysis of unvoiced speech in accordance with the invention. The target signal $x_w(n)$ shown entering encoder 300 is generated in an identical manner as shown and described with reference to FIG. 2, thus those elements are not explained here. As is clear from a comparison of FIG. 2 and FIG. 3, a repetition analysis block 302 and a dispersion matrix block 304 are added to the prior art configuration in accordance with the invention.

Within the repetition analysis block 302, the short-term subframe repetition factor $\tau_s$ is estimated using an unbiased normalized autocorrelation estimator, as defined by the following expression:

$$r_{max} = \frac{\max_\tau \left\{ \frac{1}{L-\tau} \sum_{i=0}^{L-\tau-1} x_w(i) x_w(i+\tau) \right\}}{\frac{1}{L-\tau_{max}} \left( \left( \sum_{i=0}^{L-\tau_{max}-1} x_w^2(i) \right) \left( \sum_{i=\tau_{max}}^{L-1} x_w^2(i) \right) \right)^{1/2}}, \tau_{low} \le \tau \le \tau_{high}, \tag{13}$$

where L is the subframe length, and $\tau_{low}$ and $\tau_{high}$ are the limits placed on the pitch search. In the preferred embodiment, L=53 or 54, $t_{low}$=31, and $t_{high}$=45. Also, the value of $\tau$ which maximizes the numerator in Eq. 13 is denoted as $\tau_{max}$ and the corresponding autocorrelation value is denoted as $r_{max}$. The following expression is then used to determine the short-term subframe repetition factor $\tau_s$:

$$\tau_s = \begin{cases} \tau_{max}, & r_{max} > r_{th} \\ 0, & \text{otherwise} \end{cases} \tag{14}$$

where $r_{th}$=0.15.

The subframe repetition information is then used in conjunction with a variable configuration multipulse (VCM) speech coder which introduces the concept of the dispersion matrix. A VCM speech coder is described in Ser. No. 09/086,149 filed on the same date herewith, assigned to the assignee of the present invention and incorporated herein by reference. The purpose of the dispersion matrix $\Lambda$ is to duplicate pulses on intervals of $\tau_s$ so that the energy from the codebook output signal $c'_k$ is "dispersed" over time to more closely match the noisy, unvoiced target signal. That is, the codebook output signal $c'_k$ may contain only three non-zero pulses, but after multiplication by the dispersion matrix $\Lambda$ the resulting excitation vector $c_k$ may contain up to six. Also in accordance with the invention, the dimension of the codebook output signal $c'_k$ is less than the dimension of the excitation vector $c_k$. This allows the resolution of the search space to be increased, as described below:

The MMSE criteria for the current invention can be expressed as:

$$\min_k \{ (x_w - \gamma_k H \Lambda c'_k)^T (x_w - \gamma_k H \Lambda c'_k) \}, 0 \le k < M. \tag{15}$$

As in Eq. 11, the mean squared error is minimized by finding the value of k the maximizes the following expression:

$$\max_k \left\{ \frac{(x_w^T H \Lambda c'_k)^2}{c'^T_k \Lambda^T H^T H \Lambda c'_k} \right\}, 0 \le k < M. \tag{16}$$

As before, the terms $x_w$, H, and Λ have no dependence on the codebook index k, we can let $d'^T = x_w^T H\Lambda$ and $\Phi' = \Lambda^T H^T H \Lambda = \Lambda^T \Phi \Lambda$ so that these elements can be computed prior to the search process. This simplifies the search expression to:

$$\max_k \left\{ \frac{(d'^T c'_k)^2}{c'^T_k \Phi' c'_k} \right\}, 0 \le k < M, \tag{17}$$

which confines the search to the codebook output signal $c'_k$. This greatly simplifies the search procedure since the codebook output signal $c'_k$ contains very few non-zero elements.

In accordance with the present invention, the dispersion matrix Λ for non-zero $\tau_s$ is defined as:

$$A = \begin{bmatrix} 1 & 0 & \cdots & 0 \\ 0 & 1 & \ddots & 0 \\ \vdots & \ddots & \ddots & \vdots \\ 1 & \ddots & \ddots & 1 \\ 0 & 1 & \ddots & 0 \\ 0 & 0 & \ddots & \vdots \\ \vdots & \ddots & \ddots & \vdots \end{bmatrix}, \tag{18}$$

where Λ is an L×40 dimension matrix consisting of a leading ones diagonal, with a ones diagonal following every $\tau_s$ elements down to the Lth row. In the case of $\tau_s=0$, Λ is defined as the L×L identity matrix $I_L$. We can then form the FCB contribution as $c_k = \Lambda c'_k$, where $c'_k$ is defined as a vector of dimension:

$$dim\{c'_k\} = \begin{cases} 40, & \tau_s > 0 \\ L, & \text{otherwise}, \end{cases} \tag{19}$$

in which $c'_k$ contains only three non-zero, unit magnitude elements, or pulses. The allowable pulse positions for all values of the codebook index k are defined as:

$$p_i \in \begin{cases} (N_1 n + i - 1), & 0 \le n < P_1, 1 \le i \le N_1, \tau_s > 0 \\ \lfloor ((N_2 n + i - 1)L / N_2 P_2) + 0.5 \rfloor, & 0 \le n < P_2, 1 \le i \le N_2, \tau_s \le 0, \end{cases} \tag{20}$$

where $N_1=4$ and $N_2=3$ are the number of reserved pulses, $P_1=10$ and $P_2$32 11 are the number of positions allowed for each pulse, L=53 (or 54) is the subframe length, and ⌊x⌋ is the floor function which truncates x to the largest integer ≦x. As the bottom part of Eq. 20 is the "fallback" configuration as described in the prior art, only the top part requires attention.

According to Eq. 20, although there are $N_1=4$ pulses reserved, there are only three pulses defined within $c'_k$; in the preferred embodiment, the third pulse can occupy either the third or fourth "track", as it is sometimes referred. Table 1 illustrates this point more clearly.

TABLE 1

Pulse Positions for Unvoiced Speech ($\tau_s > 0$)

| Pulse Number | Allowable Positions (within $c'_k$) |
|---|---|
| $\rho_1$ | 0, 4, 8, 12, 16, 20, 24, 28, 32, 36 |
| $\rho_2$ | 1, 5, 9, 13, 17, 21, 25, 29, 33, 37 |
| $\rho_3$ | 2, 6, 10, 14, 18, 22, 26, 30, 34, 38, 3, 7, 11, 15, 19, 23, 27, 31, 35, 39 |

Using this configuration, the number of bits allocated for the unvoiced FCB is as follows: 11 bits for the pulse positions ($10\times10\times10\times2<2^{11}=2048$), four bits for the "pseudo pitch," and one bit for the global sign pattern of the pulses: [+, −, +] or [−, +, −] in the event that the position of $p_3$ is in the top row (see Table 1), or [+, −, −] or [−, +, +] in the event that the position of $p_3$ is in the bottom row. This gives a total of 16 bits per subframe. The complete bit allocation in accordance with the invention (4.0 kbps every 20 ms) is shown in Table 2. As mentioned earlier, the number of bits dedicated for repetition (pitch) information is actually greater for unvoiced mode than for voiced mode.

TABLE 2

Voice vs. Unvoiced Bit Allocation

| Parameter | Number of Bits: Voiced | Number of Bits: Unvoiced | Description |
|---|---|---|---|
| V/UV | 1 | 1 | Voicing mode indicator |
| A (z) | 21 | 19 | LPC coefficients |
| τ | 7 | 0 | Pitch delay |
| β | 3 × 3 | 0 | ACB gain |
| $\tau_s$ | 0 | 3 × 4 | Repetition factor |
| κ | 3 × 10 | 3 × 12 | FCB index |
| γ | 3 × 4 | 3 × 4 | FCB gain |
| | 80 | 80 | Total |

Figure 7:
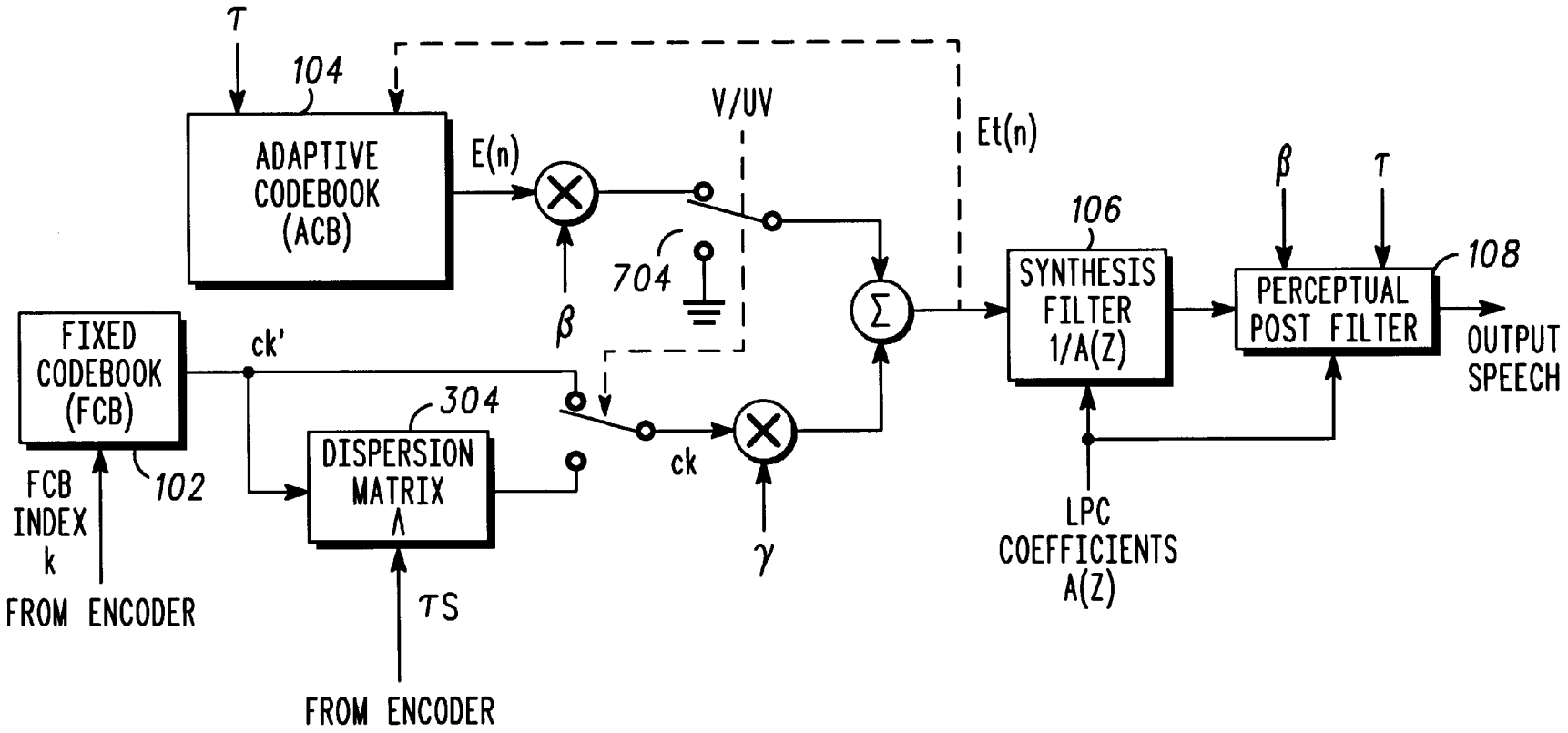
FIG. 7 generally depicts a fixed codebook (FCB) CELP decoder implementing closed loop analysis of unvoiced speech in accordance with the invention.

FIG. 7 generally depicts a fixed codebook (FCB) CELP decoder 700 implementing closed loop analysis of unvoiced speech in accordance with the invention. Several blocks shown in FIG. 7 are common with blocks shown in FIG. 1, thus those common blocks are not described here. As shown in FIG. 7, the dispersion matrix 304 is included in decoder 700. When a voiced/unvoiced signal (V/UV) used to control switch 704 represents a voiced signal, switch 704 is set to the position shown in FIG. 7. In this configuration, decoder 700 operates as a prior art decoder. However, when voiced/unvoiced signal (V/UV) represents an unvoiced signal, switch 704 is set to the opposite position, disabling output from the adaptive codebook 104 and routing the output from the fixed codebook 102 through dispersion matrix 304. As can be seen from FIG. 7, codebook index k and repetition factor $\tau_s$ received from encoder 300 are used in fixed codebook 102 and dispersion matrix 304 respectively. The output from the dispersion matrix 304 is the excitation sequence $c_k$ which is then passed through synthesis filter 106 and perceptual post filter 108 to eventually generate the output speech signal in accordance with the invention.

Important to note is that, while only 10–15% of speech frames are unvoiced, it is this 10–15% which contributes to much of the noticeable deficiencies in the prior art. Simply stated, the present invention dramatically improves the subjective performance of unvoiced speech over the prior art. The performance improvements realized in accordance with the invention is based on three different principles. First, while $\tau_s$ has been defined in terms of a pitch period, there is nothing at all periodic about it. Basically, the autocorrelation window used in determining $\tau_s$ is so small that it is statistically invalid, and that the estimated pitch period $\tau_s$ is itself a random variable. This explains why the resulting synthesized waveform for unvoiced speech does not generally exhibit any periodic tendencies. Second, FCB closed loop analysis of unvoiced speech in accordance with the invention results in much higher correlation with the target signal $x_w(n)$, which results in a much more accurate energy match than in the prior art. Third, in the event of a misclassification (i.e., classifying a voiced frame as unvoiced), FCB closed loop analysis of unvoiced speech in accordance with the invention can reasonably represent a truly periodic waveform. This is due to a higher inter-subframe correlation of $\tau_s$, and thus, reduction of the "randomness" property.

In addition to the performance aspects of the invention, there lies an inherent complexity benefit as well. For example, when a multi-pulse codebook is increased in size, the number of iterations required to fully exhaust the search space grows exponentially. For the present invention, however, the added complexity from adding the repetition parameters requires only the calculation of equation 13, which are negligible when compared to the addition of the equivalent number of bits (4) to the multi-pulse codebook search, which would produce a 16-fold increase in complexity.

Figure 4:
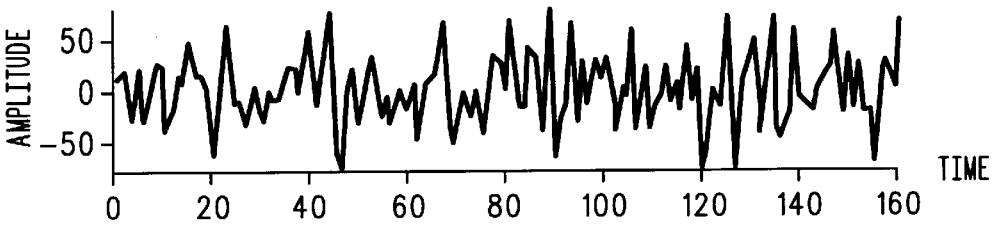
FIG. 4 generally depicts an original unvoiced speech frame.
Figure 5:
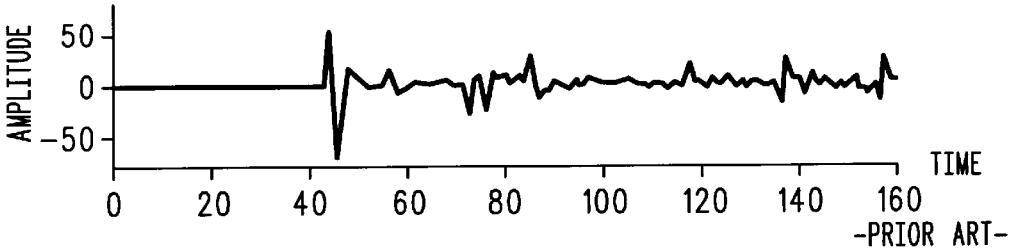
FIG. 5 generally depicts a 4.0 kbps (halfrate) synthesized waveform using prior art method.
Figure 6:
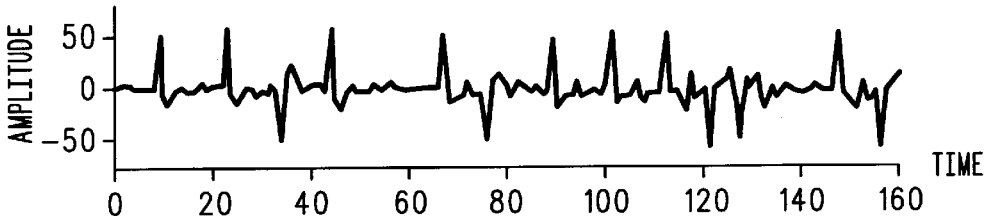
FIG. 6 generally depicts a 4.0 kbps (halfrate) synthesized waveform using FCB closed loop analysis of unvoiced speech in accordance with the invention.

The performance effects can be readily observed with reference to FIG. 4, FIG. 5 and FIG. 6. FIG. 4 generally depicts an original unvoiced speech frame, FIG. 5 generally depicts a 4.0 kbps synthesized waveform using the prior art methods and FIG. 6 generally depicts a 4.0 kbps synthesized waveform using FCB closed loop analysis of unvoiced speech in accordance with the invention. As can be seen, the consistency of the amplitude of the pulses of FIG. 6 compared to the prior art method of FIG. 5 indicates an improved stability in accordance with the invention by increased resolution of the search. Additionally, the waveform shown in FIG. 6 generally has a higher energy when compared to the waveform shown in FIG. 5, which indicates that the synthesized waveform matches the target waveform more closely, resulting in higher a FCB gain.

While the invention has been particularly shown and described with reference to a particular embodiment, it will be understood by those skilled in the art that various changes in form and details may be made therein without departing from the spirit and scope of the invention. For example, while a speech coder for a 4 kbps application has been described, FCB closed loop analysis of unvoiced speech in accordance with the invention can be equally implemented in the Adaptive Multi-Rate (AMR) codec soon to be proposed for GSM at a rate of 5.5 kbps. In this embodiment, 12 bits are allocated for a repetition factor $\tau_s$ and 60 bits are allocated for a codebook index k in a 5.5 kbps speech coder when the voicing mode is unvoiced. In fact, FCB closed loop analysis of unvoiced speech in accordance with the invention can be beneficially implemented in any CELP-based speech codecs. The corresponding structures, materials, acts and equivalents of all means or step plus function elements in the claims below are intended to include any structure, material, or acts for performing the functions in combination with other claimed elements as specifically claimed.

What we claim is:

1. A method for coding an unvoiced speech signal comprising the steps of:

partitioning the unvoiced speech signal into finite length blocks;

analyzing the finite length blocks to generate an autocorrelation sequence;

producing a short-term repetition factor based on a maximum of the autocorrelation sequence;

coding each finite length block using the repetition factor to produce a codebook index representing a codebook sequence, wherein 12 bits are allocated for the repetition factor and 60 bits are allocated for the codebook index in a 5.5 kbps speech coder; and transmitting the codebook index and the repetition factor to a destination, whereby the sequence corresponding to the codebook index is processed according to a function of the repetition factor to construct an estimate of the unvoiced speech signal.

2. The method of claim 1, wherein the codebook index and the repetition factor represent an excitation sequence in a CELP speech coder.

3. A method of coding speech comprising the steps of:

determining a voicing mode of an input signal based on at least one characteristic of the input signal;

analyzing, when the voicing mode is unvoiced, the input signal to generate an autocorrelation sequence;

producing short-term repetition parameters based on a maximum of the autocorrelation sequence; and allocating bits in a codeword to the short-term repetition parameters when the voicing mode is unvoiced, wherein 12 bits are allocated for a repetition factor $\tau_s$ and 60 bits are allocated for a codebook index k in a 5.5 kbps speech coder.

* * * * *